United States Patent [19]

Murga

[11] Patent Number: 5,069,462

[45] Date of Patent: Dec. 3, 1991

[54] ROLLER SKATE INCLUDING AT LEAST TWO ROLLERS ALIGNED ALONG A MEDIAN PLANE

[76] Inventor: José Murga, 9C, chemin des Rouilleres, CH-2000 Neuchatel, Switzerland

[21] Appl. No.: 675,017

[22] Filed: Mar. 22, 1991

Related U.S. Application Data

[63] Continuation of Ser. No. 369,041, filed as a PCT/CH88/00192, Oct. 17, 1988, abandoned.

[30] Foreign Application Priority Data

Oct. 23, 1987 [FR] France ..... 87 14884

[51] Int. Cl.[5] ..... A63C 17/22

[52] U.S. Cl. ..... 280/23; 280/11.2; 301/5.7

[58] Field of Search ..... 280/11.23, 11.22, 11.21, 280/11.19, 11.36, 11.24, 842, 843; 301/5.3, 5.7

[56] References Cited

U.S. PATENT DOCUMENTS

| | | | |
|---|---|---|---|
| 988,533 | 4/1911 | Zverina | 280/11.23 |
| 1,524,286 | 1/1925 | Bried | 280/11.23 |
| 1,801,205 | 4/1931 | Mirick | 280/11.2 |
| 2,141,122 | 12/1938 | Boden | 301/5.7 |
| 2,166,767 | 7/1939 | Petermann | 280/11.22 |
| 2,570,349 | 10/1951 | Kardhordo | 280/11.22 |
| 4,072,317 | 2/1978 | Pommering | 280/11.23 |
| 4,418,929 | 12/1983 | Gray | 280/11.23 |

FOREIGN PATENT DOCUMENTS

| | | | |
|---|---|---|---|
| 0127734 | 12/1984 | European Pat. Off. . | |
| 2745040 | 12/1979 | Fed. Rep. of Germany . | |
| 746228 | 12/1931 | France | 280/11.2 |
| 2312174 | 12/1976 | France . | |
| 580976 | 9/1976 | Switzerland . | |

OTHER PUBLICATIONS

WO89/03712 5/1989.

*Primary Examiner*—David M. Mitchell
*Attorney, Agent, or Firm*—Frost & Jacobs

[57] ABSTRACT

The skate includes an under-frame (3) equipped with two or several rollers aligned one behind the other in a common median plane. Each roller (4, 5) has a shape of a narrow-bobbin, with two circular flanges provided with bands and a central hollowed hub, fixed inside a ball-bearing. This bearing is put in an orifice of a central plate (24) of the under-frame, this plate holding also a front buffer-stop (6) and a back buffer-stop (7). An instrument absorbing the shocks in the radial direction is intercalated between the bearing and the plate (24). Preferably, the under-frame (3) of the skate is equipped with a support for a leg (1) which is articulated in relation to a transverse axis (Y) at the level of the ankle. A braking mechanism of the rollers (4, 5) can be fixed on the central plate (24) of the under-frame. Thanks to the special shape of the rollers, bearings and the under-frame are lightened.

17 Claims, 4 Drawing Sheets

Figure 1:
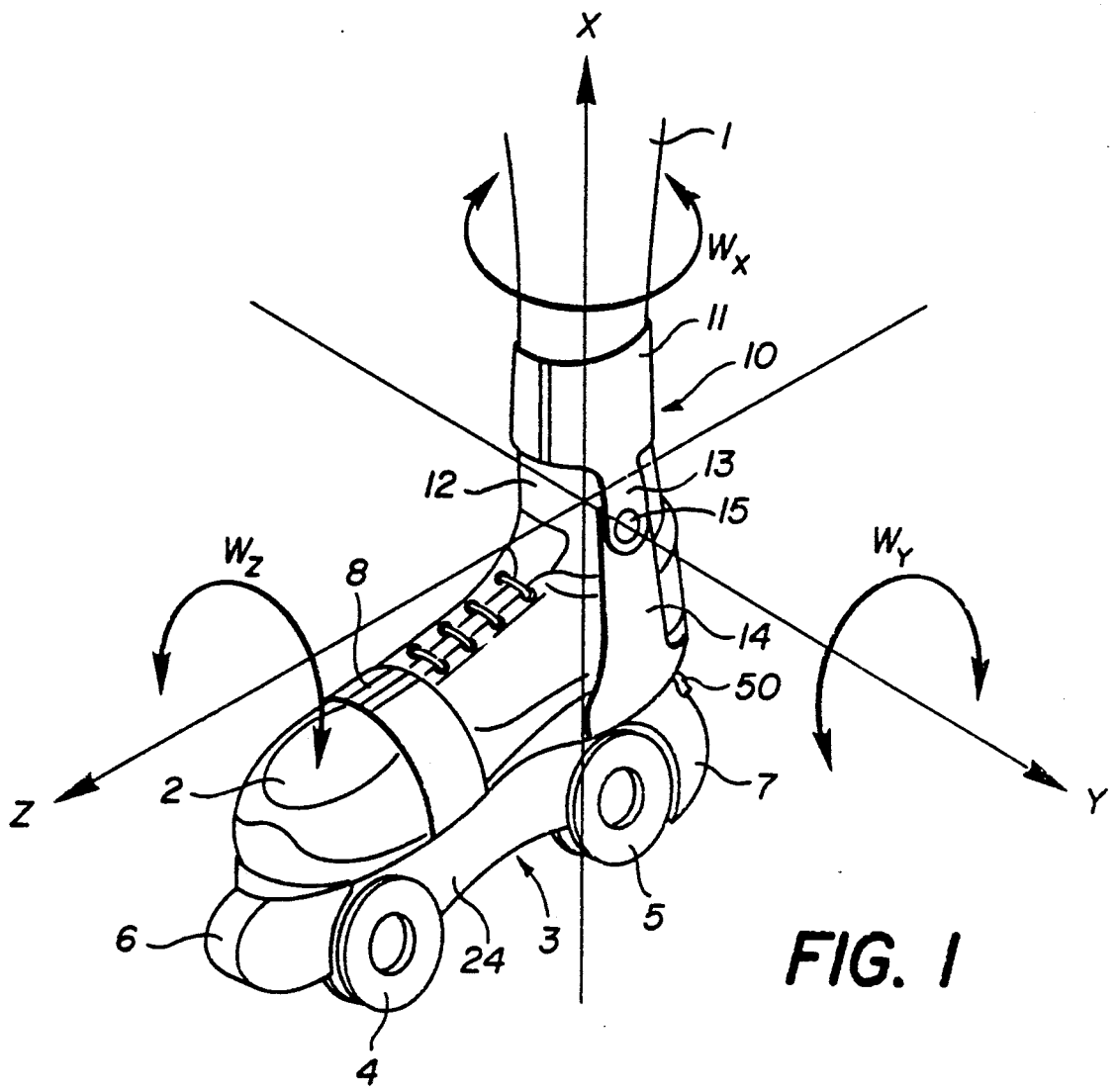

1
A
1'
11
10
1"
19
4

1
11
19
4
3
5

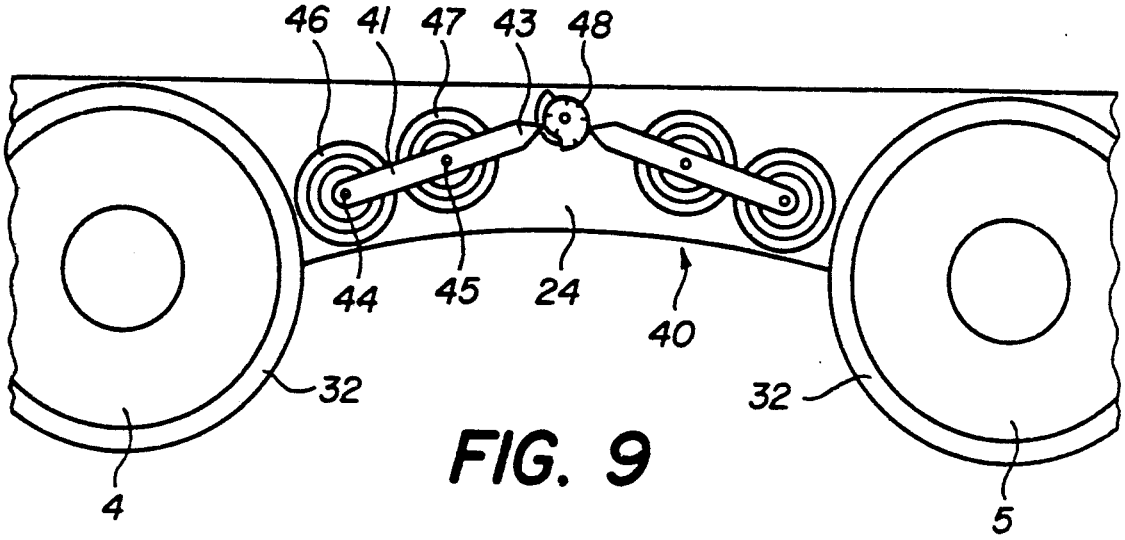
FIG. 9
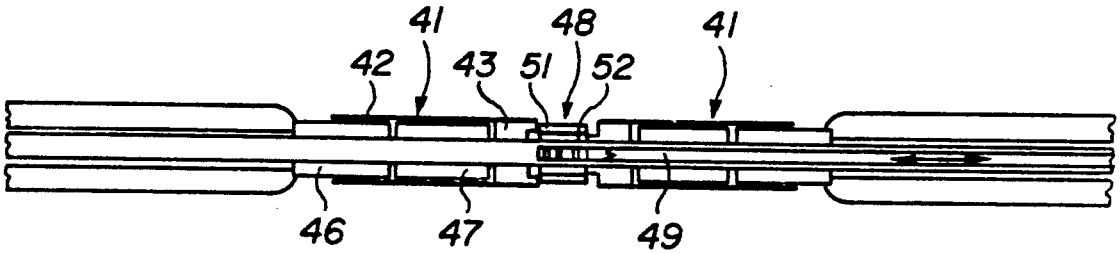
FIG. 10
FIG. 11
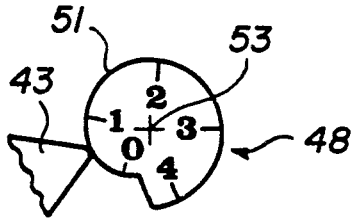
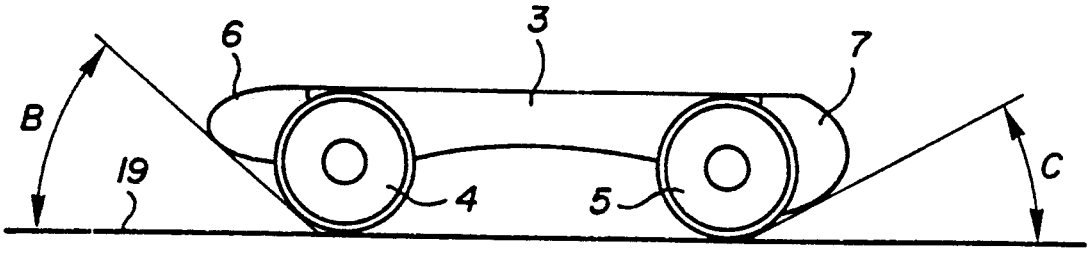
FIG. 12

ROLLER SKATE INCLUDING AT LEAST TWO ROLLERS ALIGNED ALONG A MEDIAN PLANE

This is a continuation of application Ser. No. 07/369,041, filed as a PCT/CH88/00192, Oct. 17, 1988 now abandoned.

The present invention relates to a roller skate including an under-frame, at least two rollers fixed on a lower part of this under-frame and aligned one behind the other, along a common median plane perpendicular to their axes of rotation, and support means to fix the under-frame to a foot and to the corresponding leg of a user.

The French certificate of utility A-2 312 174 and the corresponding U.S. Pat. No. A-4 072,317 describe a skate of the same kind, including two aligned and relatively large rollers. Each roller is fixed under the under-frame between two parallel arms holding the extremities of its axle. In order to have the desired rigidity, this known setting requires at least four very rigid arms, as well as axles of rollers, which are relatively large and long enough to hold each roller by two parallel bearings. Thus, this construction presents a rather significant weight. Moreover, the arms form, on each side of the rollers, projecting elements which can hit against the ground or against various obstacles when one roller-skates, which is a source of dangers and damages.

The U.S. Pat. No. A-4,418,929 also shows a skate of the same kind, but equipped with two narrow rollers fixed between two vertical plates of the under-frame. This structure should also be rather heavy in order to have the desired rigidity, especially regarding the transverse deformations, and the axles of the rollers are also laterally protuberant.

The purpose of the present invention is to supply a skate of the type indicated in the preamble, arranged so as to avoid the above mentioned disadvantages, in order to allow a great freedom of evolution thanks to its lightness, to its stability and to the absence of protuberant lateral elements.

For this purpose, the roller-skate in accordance with the invention, is characterized by the fact that each roller includes two circular flanges, substantially parallel and with the same diameter, and by the fact that these two flanges are joined to a central tubular portion of lesser diameter, which is fixed inside a rolling bearing or pillow-block fixed on the under-frame and located in the median plane.

In this manner, the wheels have the general shape of a very narrow bobbin that can rest on the ground by its two flanges when the bobbin is perpendicular to the ground, or just by one flange when it is inclined. Moreover, this bobbin can be supported only at the proximity of its median plane, which allows avoidance of any protuberant frame at the extremities of the bobbin, i.e., on the faces of the skate. To be lightened, each roller can be hollowed out by a central hole axially traversing the entire roller.

Preferably, the said lower part of the under-frame includes a longitudinal central plate located in the median plane and in which are mounted the bearings of the two rollers, this plate being joined to a support plate, stretching out under the foot of the user.

In a form of a special embodiment, an elastic element is placed between each rolling bearing and the under-frame. For that purpose, each rolling bearing can include an external ring, externally equipped with a radial border fixed with a radial clearance in a groove of the under-frame, an elastic material being inserted between this border and the bottom of the groove to absorb the shocks. The rolling Plummer-block can be a ball-bearing the internal ring (race) of which is formed by the central tubular portion of the roller. On the other hand, the external border of each flange of the rollers can be provided with a band of elastomer.

In a special embodiment, a braking mechanism of the rollers is put on the central plate of the under-frame and includes braking means fixed in a sliding manner along the plate to be in contact with the rollers, and a central control mechanism. Such braking means can include at least a sliding frame comprising a wheel pressed upon the central plate of the under-frame and arranged to roll on the border of the flange or the corresponding roller. On the other hand, at least one of the rollers can be equipped with a mechanism of rotation in one way only in order to avoid a backward rotation.

In a form of an advantageous embodiment, the support means include a collar arranged to be fixed around the leg of the user, and connected to the under-frame transversely by a rigid mechanism, but articulated in relation to a transverse axis at the level of the ankle of the user.

Figure 4:
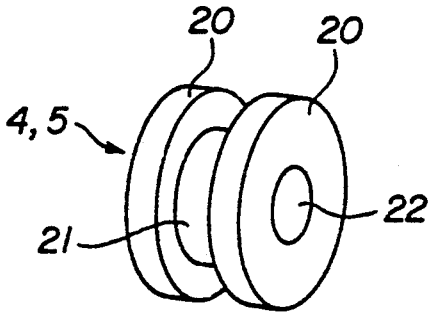
Figure 5:
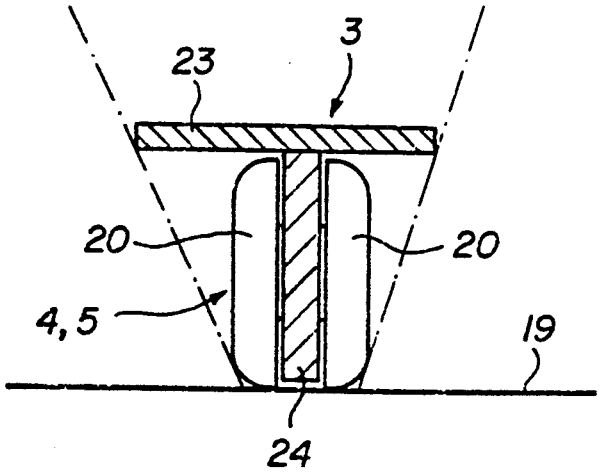
Figure 2:
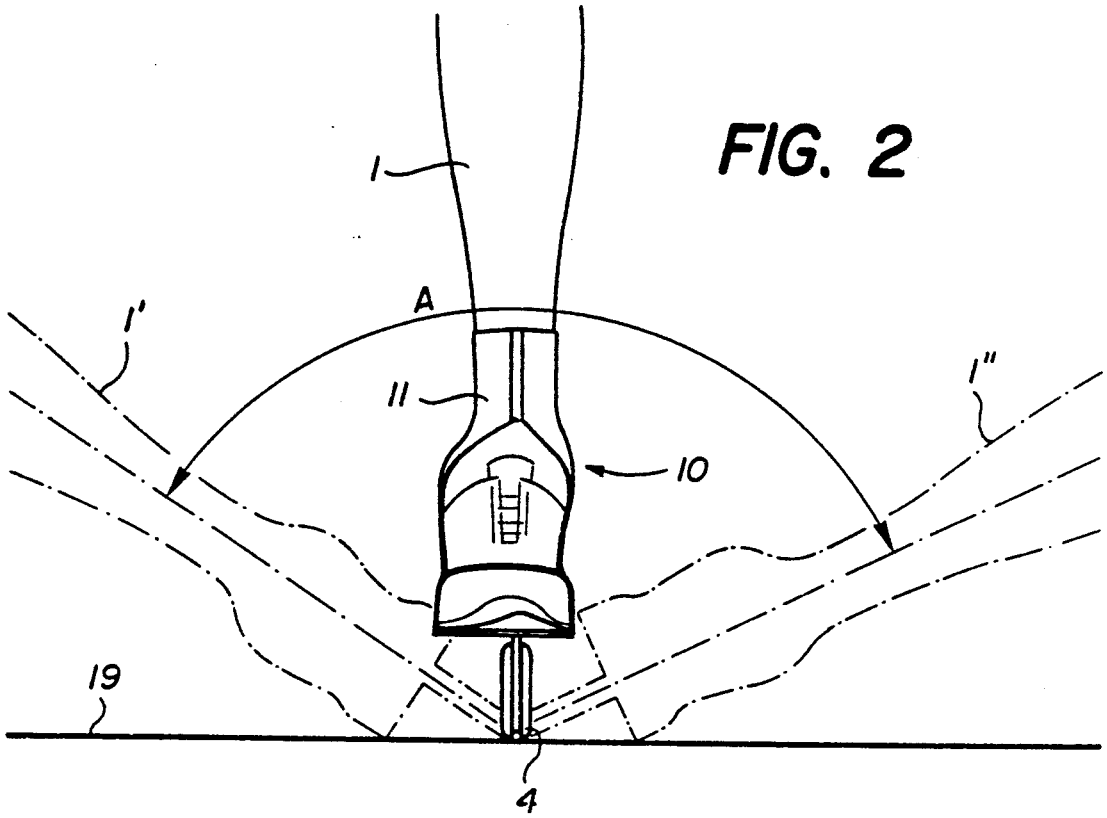
Figure 3:
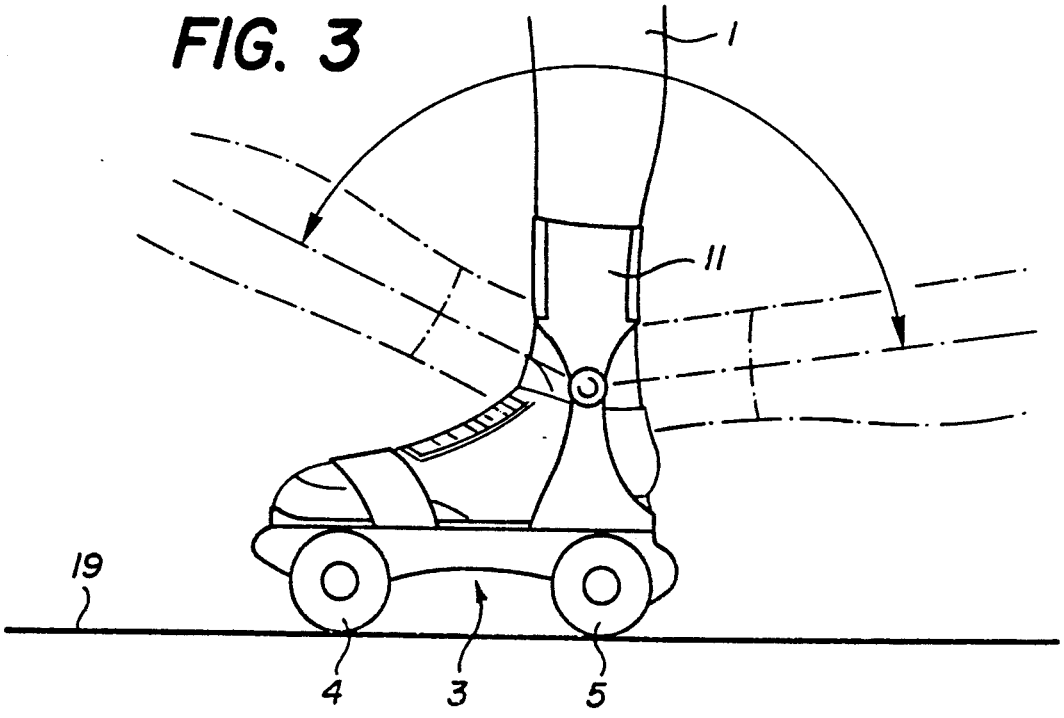
Figure 6:
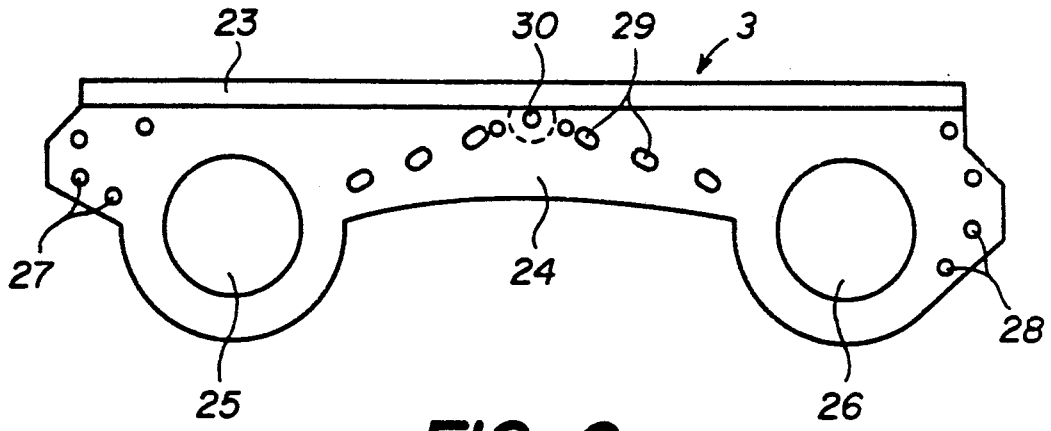
Figure 7:
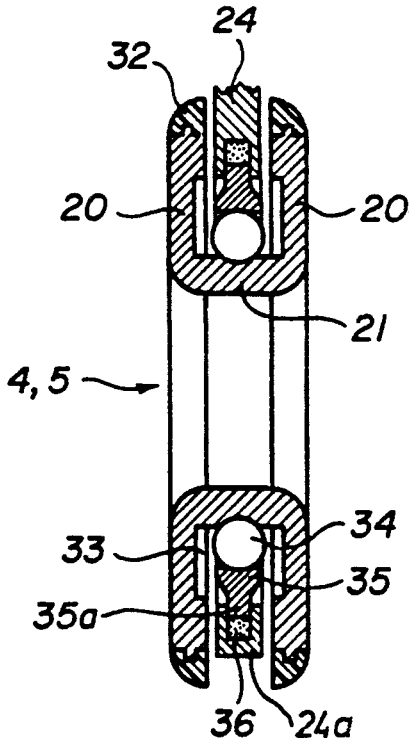
Figure 8:
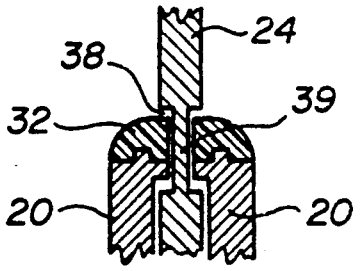

The present invention will be better understood with the following description of an exemplary embodiment, in reference to the attached drawings, in which:

FIG. 1 is a diagrammatic perspective view of a roller skate in accordance with the invention, fixed to the foot and leg of a user, FIG. 2 is a front view showing the possibilities of lateral inclination of the skate and of the leg, FIG. 3 is a lateral view showing the possibilities of longitudinal inclination of the leg when the two rollers of the skate rest on the ground, FIG. 4 is a diagrammatic perspective view of a bobbin-shaped roller, FIG. 5 is a view in a transverse section showing the profile of the under-frame of the skate, FIG. 6 is a lateral view of this under-frame, FIG. 7 is a view in a transverse section of a form of a preferred embodiment of a roller and of its mounting, FIG. 8 illustrates in a partial transverse section another embodiment of a roller, FIGS. 9 and 10 represent respectively in a lateral view and in a plan view, a braking mechanism of the rollers, FIG. 11 represents a control cam of the braking mechanism, and FIG. 12 is a lateral view showing the disposition of two buffer-stops on the under-frame of the skate.

FIG. 1 shows a roller-skate in accordance with the invention, fixed to a leg 1 and to the corresponding foot or to the shoe 2 of a user. The skate includes a rigid under-frame 3 supporting the sole of the shoe 2 and equipped, in its lower part, with a front roller 4, a back roller 5, a front buffer-stop 6 and back buffer-stop 7. The under-frame 3 is attached to the shoe 2 with the help of a conventional adjustable collar 8. Also, the skate includes a leg holder 10 having a collar 11 adapted to be fixed around the leg 1 of the user and connected to the under-frame 3, on each side of the ankle 12 of the user, by a pair of rigid metallic blades 13 and 14, articulated to themselves at 15 at the level of the ankle 12 to allow the collar 11 to swing with the leg 7 to the front or to the back, by executing a turn $w_y$ in relation to a transverse axis Y as shown in FIG. 3. In return, a relative lateral swing of the under-frame 3 in relation to the leg 1, by a rotation $w_z$ around the longitudinal axis Z, is prevented by the rigidity of the leg holder 10. However, the leg 1 can nevertheless execute a certain turn $w_x$ around its longitudinal axis X inside the collar 11, so that the skater can direct the axis X of his foot as he desires.

The transverse rigidity of the leg holder 10 considerably relieves the efforts to be provided by the skater at the level of the ankle. It has also the function to maintain the common median plane of the two rollers 4 and 5, practically in coincidence with the longitudinal axis X of the leg 1, and to incline it laterally with the leg in relation to the ground 19 as is shown in FIG. 2. The angle A between the extreme positions 1' and 1'' of inclination of the leg is very important, thanks to the narrowness of the rollers, and to the absence of protuberant lateral elements, at the level of the rollers.

FIG. 4 shows in perspective schematically the bobbin shape of the rollers 4 and 5, with the two flanges 20 which are parallel and symmetrical in relation to the median plane, and which are rigidly connected by a central tubular portion on hub 21, the external diameter of which is smaller than the rollers. The roller includes a central hole 22 that allows lightening it.

FIGS. 5 and 6 show more specifically the shape of the under-frame 3, essentially formed by a horizontal plate 23 supporting the sole of the shoe and by a vertical plate 24 pierced by two large circular orifices 25 and 26 for the setting of the tubular portions 21 of the rollers 4 and 5, the sides 20 of each roller being respectively on one side and the other side of this plate 24. Of course, one could provide a similar skate having more than two consecutive rollers, mounted in alignment or following a curved longitudinal profile. Also, the plate 24 is pierced with holes 27 and 28 for the fixation of the front 6 and back 7 buffer-stops with screws, and with holes 29 and 30 for the setting of a braking mechanism that will be described later.

FIG. 7 shows more in detail a form of advantageous embodiment of a roller 4, 5 and its mounting in the plate 24 of the under-frame. The tubular portion 21 and the flanges 20 of the roller are made of a single rigid piece, preferably metallic, the periphery of the flanges being provided with a band 32 of relatively rigid elastomer which has a quarter round cross-section. Near the tubular portion 21 an enlarged space 33 is provided between the two flanges 20 which encloses a ball-bearing 34 having an external ring (race) 35, the tubular portion 21 working directly as an internal ring of the ball-bearing. The ring 35 presents externally a flat border **35*a* that is fit into a rectangular profiled groove, formed in the thickness of the plate 24 and including a relatively soft elastomer 36 which absorbs the shocks suffered by the roller, the ring 35 then sliding radially in the groove. In this example, the plate 24 must obviously have a removable part 24*a* around the lower half of each bearing 34**, to allow the setting of the rollers.

In the variation shown in the FIG. 8, one succeeds in reducing to a few millimeters the distance between the two bands 32 of the roller, by giving to the flanges 20, a cross section in a shape of a vice and by providing in each side of the plate 24, a groove 38 in an arcuate shape for the passage of the band 24. As the thin part 39 of the plate 24 is arcuate, it does not result in a significant weakening of the plate. In return, one of the sides 20 must be removable to allow the mounting and the unmounting of the roller.

Further, the bobbin-shaped rollers allow advantageously the setting of a mechanism of rotation in one direction (not shown) set between the internal surface of one side 20 and a lateral surface of the plate 24 or of the ring 35. It can be, for example, a metallic oblique bladed stop washer, co-operating with thin radial grooves formed in the said surfaces, or a ball-bearing in a "free wheel" style, which jams automatically as soon as it primes a backward rotation. In this way, the roller can only turn forward and it allows the skater to propel himself easily, especially on a slope.

FIGS. 9 to 11 show an adjustable braking mechanism 40 that is fixed on the plate 24 of the under-frame between the two rollers 4 and 5. For each roller, the braking mechanism includes a sliding frame 41 having one pair of metallic plates 42 each equipped with a head 43 and connected to one another by two axles 44 and 45 that can slide in the oblong holes 29 (FIG. 6) of the under-frame. Each axle 44 and 45 supports a pair of braking wheels 46 and 47 made of a compressible material, these wheels being disposed on both sides of the plate 24 and being pressed against it, for example by means of plastic stop washers, in order to assure a braking by friction against this plate. The heads 43 of the two sliding frames bear against a central cam 48 rotation of which is effected by a rack 49 which slides lengthwise in a groove of the under-frame, under the power of a back trigger 50 (FIG. 1) and of a release spring. Also, the rack 49 is maintained in position by a locking pawl mechanism (not shown) that one can unlock by raising the trigger. In the present case, it is noted that the cam 48 includes, on each side of the under-frame, cam surfaces 51 and 52 distinct for the back and front braking mechanisms, but which are similar and jut out angularly one from the other to produce simultaneously the same effect of braking in the two mechanisms.

The operation of the braking mechanism will also be described in reference to FIG. 11 which shows the profile of one of the peripheral surfaces 51 of the cam 48, this cam being rotatable around its axis 53. The head 43 of the sliding frame 41 is pressed against the surface 51 only by the elasticity of the material composing the braking wheels 46 and 47. Various positions of the support of the head 43 against the surface 51 during the rotation of the cam are marked by a gradation from 0 to 4. In position 0, the frame 41 is stepped back enough in relation to the corresponding roller 4, 5 so that the wheel 46 does not touch the band 32 and so the roller will not be braked. In position 1, the wheel 46 rests lightly against the band 32 and slips on it, because its friction against the plate 24 is strong enough to prevent it from turning at this stage. In position 2, on the contrary, the friction of the wheel 46 on the band 32 becomes stronger and makes the wheel 46 turn, the braking then taking place against the plate 24. In position 3, the push exercised by the roller is strong enough for the wheel 46 to move back until it touches the second braking wheel 47, thanks to its deformation by elasticity or, in that case, thanks to an elastic structure sliding from its axis 44 in the frame 41. The braking is then reinforced by the friction of the wheel 47 against the plate 24. Finally, in position 4, an even stronger braking is obtained that allows to completely stop the wheel, by application of the head 43 against the wheel 47 thanks to the elasticity of this wheel 47 around the axle 45. The rack 49 is held by a stop so that the cam 48 cannot turn beyond the position 4.

This structure allows resolving in a simple manner the problem of the proportioned and simultaneous braking of all the rollers of a skate to allow the roller-skater to run over, without danger, relatively steep downward slopes. The roller skater can increase at any time the effort of braking of a skate by hitting on the control trigger 50 by means of the front buffer-stop 6 of the other skate. The releasing can be done by raising the trigger by means of the same buffer-stop or by hand.

FIG. 12 shows more specifically the use of the front and back buffer-stops 6 and 7. The roller-skater can use the front buffer-stop 6 to propel himself. He then bends his foot to the front, under an angle greater than the angle B that equals 41° in the example, and he presses the buffer-stop 6 against the ground 19 to propel himself forward. The buffer-stop 7 serves for braking by friction against the ground. For this, the skater bends his foot to the back, at an angle higher than the angle C that equals here, preferably, 29°. One notices that the sum of the angles B+C, that is to say 70°, is high enough to give the skater a great freedom to bend his foot to the front or to the back, without the buffer-stops touching the ground while he roller skates.

The present invention is not limited to the example of embodiments above described, but on the contrary extends to any kind of modifications or variations obvious to a man skilled in the art. In particular, one will be able to use any appropriate materials for the building of different elements, for example steel, light metal or a rigid synthetic material for the under-frame and for the bobbin-shaped rollers. The articulated leg holder 10 can also be the subject of multiple variations from the standpoint of the building, the stuffing and the instruments of fixation to the leg, especially as shown in the already cited publications. In that case, it can include a half of a shell, applied on a certain height along the leg, or even be replaced by a complete articulated or lengthwise flexible shoe, on which is fixed the under-frame 3. The publications German-A-2 745 040 and Swiss-A- 580'976 show different ways to fix the sole of the shoe on an under-frame of a skate formed principally by a central longitudinal plate.

With regard to conventional roller-skates with two wheels, the roller-skates in accordance with the invention, have the advantage of a central under-frame that can be very rigid while being simple and light. The central plate of the under-frame holds at the same time, the 2 wheels, the buffer-stops and, if such should be the case, the braking mechanism. Combined with the bobbin-shaped wheels, this simple structure allows realization of a lighter and less expensive skate than the conventional skates. Thanks to their hollowed hub and high diameter, the bobbin-shaped rollers are light and have an aesthetic aspect, and moreover, are mounted in high diameter bearings that are not very encumbering while being very resistant to shocks thanks to the great number of balls that they can hold. Because the two bands of each roller are close to the median plane, the bearing points on the ground are always very close to this median plane. It allows the user to roller-skate in a more precise, easier and more secure way. The skates, in accordance with the invention, allow the skater the same evolutions as an ice-skater. The user, wearing these skates, can also travel easily in the street or in a building, on longitudinal or transverse slopes and on stairs.

The invention applies to skates intended to perform evolutions on a track or for artistic skating, as well as to skates suited to trips in the street or in buildings.

What is claimed is:

1. In a roller skate comprising an under-frame, at least two rollers fixed on a lower part of said under-frame and aligned one behind the other along a common median plane perpendicular to their axes of rotation, and support means to fix said under-frame to a foot and to a corresponding leg of a user, the improvement wherein each one of said rollers has the shape of a narrow bobbin, including two circular flanges substantially parallel and of the same outer diameter, and a central tubular portion of lesser diameter which is integrally connected to said two flanges, said tubular portion being mounted inside a rolling bearing supported by said under-frame and located in said median plane, and wherein each one of said rollers is hollowed out by a central hole axially transversing the whole roller, defining the inside of said tubular portion.

2. Roller-skate according to claim 1, wherein said lower part of said under-frame includes a central longitudinal plate located in the median plane and in which are mounted said bearings of said two rollers, said plate being joined to a support plate extending under the foot of the user.

3. Roller-skate according to claim 1, wherein said rolling bearing is a ball-bearing the internal ring of which is formed by a hub of said roller.

4. Roller-skate according to claim 1, wherein the external edge of each flange of said rollers is furnished with a band of elastomer.

5. Roller-skate according to claim 1, wherein at least one said roller is equipped with a mechanism of rotation in only one direction, to prevent rotation to the rear.

6. Roller-skate according to claim 1, wherein said support means includes a collar arranged to be fixed around the leg of a user and connected to said under-frame transversely by a rigid mechanism but articulated in relation to a transverse axis (Y) at the level of the ankle of said user.

7. In a roller skate comprising an under-frame, at least two rollers fixed on a lower part of said under-frame and aligned one behind the other along a common median plane perpendicular to their axes of rotation, and support means to fix said under-frame to a foot and to a corresponding leg of a user, the improvement wherein each one of said rollers includes two circular flanges substantially parallel and of the same outer diameter, and a central tubular portion of lesser outer diameter which is rigidly connected to said two flanges, said tubular portion being mounted inside a rolling bearing supported by said under-frame and located in said median plane, wherein said lower part of said under-frame includes a central longitudinal plate located in the median plane and in which said bearings of said two rollers are mounted, said plate being joined to a support plate extending under the foot of the user, and wherein a braking mechanism is mounted on said central plate of said under-frame and includes braking means mounted in a sliding manner along said plate to be selectively in contact with said rollers, and a central control mechanism for controlling the sliding movement of said braking means thereby providing proportioned and simultaneous braking of said two rollers.

8. Roller skate according to claim 7, wherein said braking means includes at least a sliding frame holding a wheel which bears with friction against said central plate of said under-frame and disposed to roll on the edge of a flange of the corresponding roller.

9. Roller skate according to claim 7, wherein an elastic element is placed between each said rolling bearing and said under-frame.

10. Roller skate according to claim 9, wherein each rolling bearing includes an external ring equipped externally with a radial border mounted with a radial clearance in a groove of said under-frame, and wherein said elastic element is intercalated between said border and the bottom of said groove to absorb shocks.

11. Roller skate according to claim 10, wherein said rolling bearing is a ball bearing the internal ring of which is formed by said tubular portion of said roller.

12. Roller skate according to claim 7, wherein the external edge of each flange of said rollers is furnished with a band of elastomer.

13. Roller skate according to claim 7, wherein at least one said roller is equipped with a mechanism of rotation in only one direction, to prevent rotation to the rear.

14. Roller skate according to claim 7, wherein said support means includes a collar arranged to be fixed around the leg of a user and connected to said under-frame transversely by a rigid mechanism but articulated in relation to a transverse axis (Y) at the level of the ankle of said user.

15. In a roller skate comprising an under-frame, at least two rollers fixed on a lower part of said under-frame and aligned one behind the other along a common median plane perpendicular to their axes of rotation, and support means to fix said under-frame to a foot and to a corresponding leg of a user, the improvement wherein each one of said rollers has the shape of a narrow bobbin, including two circular flanges substantially parallel and of the same outer diameter, and a central tubular portion of lesser diameter which is rigidly connected to said two flanges, said tubular portion being mounted inside a rolling bearing supported by said under-frame and located in said median plane, wherein each one of said rollers is hollowed out by a central hole axially transversing the whole roller, with no axle or bolt located within said central hole, wherein said lower part of said under-frame includes a central longitudinal plate located in the median plane and in which are mounted said bearings of said two rollers, said plate being joined to a support plate extending under the foot of the user, wherein an elastic element is placed between each said rolling bearing and said under-frame, wherein each rolling bearing includes an external ring equipped externally with a radial border mounted with a radial clearance in a groove of said under-frame, and wherein said elastic element is intercalated between said border and the bottom of said groove to absorb shocks.

16. An axleless roller for a roller skate having a configuration of a narrow bobbin, including two circular flanges substantially parallel and of the same outer diameter, a central tubular portion of lesser diameter than said flanges and integrally connected to each of said flanges, a rolling bearing mounted outside said tubular portion in closely surrounding relation thereto in a median plane between said flanges, said roller having a central hole axially transversing the whole roller defining the inside of said tubular portion.

17. The roller of claim 16, wherein said rolling bearing is a ball bearing the internal ring of which is formed by said tubular portion.

* * * * *